US005989682A

United States Patent [19]

Anderson

[11] Patent Number: 5,989,682

[45] Date of Patent: Nov. 23, 1999

[54] SCRIM-LIKE PAPER WIPING PRODUCT AND METHOD FOR MAKING THE SAME

[75] Inventor: Ralph L. Anderson, Marietta, Ga.

[73] Assignee: Kimberly-Clark Worldwide, Inc., Neenah, Wis.

[21] Appl. No.: 08/843,089

[22] Filed: Apr. 25, 1997

[51] Int. Cl.[6] ..... B31F 1/20; D21H 11/00

[52] U.S. Cl. ..... 428/152; 428/154; 428/156; 428/195; 428/198; 428/212; 428/373; 162/109; 162/111; 162/113; 162/118; 156/209; 156/295

[58] Field of Search ..... 156/209, 290, 156/291, 292, 295; 162/109, 111, 113, 118; 428/152, 212, 154, 172, 373, 156, 195, 198

[56] References Cited

U.S. PATENT DOCUMENTS

| | | | |
|---|---|---|---|
| 3,476,644 | 11/1969 | Krehnbrink . | |
| 3,597,299 | 8/1971 | Thomas et al. . | |
| 3,879,257 | 4/1975 | Gentile et al. . | |
| 4,100,017 | 7/1978 | Flautt | 428/154 |
| 4,125,659 | 11/1978 | Klowak et al. . | |
| 4,158,594 | 6/1979 | Becker et al. . | |
| 4,487,796 | 12/1984 | Lloyd et al. . | |
| 4,610,743 | 9/1986 | Salmeen et al. . | |
| 4,619,734 | 10/1986 | Andersson . | |
| 4,894,118 | 1/1990 | Edwards et al. . | |
| 5,019,211 | 5/1991 | Sauer . | |
| 5,094,717 | 3/1992 | Manning et al. . | |
| 5,129,988 | 7/1992 | Farrington, Jr. . | |
| 5,137,600 | 8/1992 | Barnes et al. . | |
| 5,494,554 | 2/1996 | Edwards et al. . | |

FOREIGN PATENT DOCUMENTS

| | | |
|---|---|---|
| 2127866 | 4/1984 | United Kingdom . |
| WO9701671 | 1/1997 | WIPO . |

OTHER PUBLICATIONS

Database WPI, Section CH, Week 9132, Derwent Publications Ltd., London, GB; Class A35, AN 91–234210; XP002074004 & JP 03 152 256A (Nippon Vilene KK); see abstract.

Database WPI, Section CH, Week 9041; Derwent Publications Ltd., London, GB; Class A23, AN 90–310339; XP002074005 & JP 02 221 448 A (Chisso Corp); see abstract.

*Primary Examiner*—Donald Loney
*Attorney, Agent, or Firm*—Dority & Manning, P.A.

[57] ABSTRACT

The present invention is generally directed to single ply scrim-like wiping products having great softness and strength. The wiping products are made from a paper web containing softwood fibers in combination with bicomponent fibers. Once formed, the paper web is treated on each side with a bonding agent in a preselected pattern. Both sides of the paper web are also creped. In order to create a wiping product with a scrim-like appearance, a reticular pattern is then embossed into the paper web. Specifically, the pattern is permanently imprinted into the product by compressing and fusing together the bicomponent fibers contained within the lines of the pattern.

33 Claims, 4 Drawing Sheets

SCRIM-LIKE PAPER WIPING PRODUCT AND METHOD FOR MAKING THE SAME

FIELD OF THE INVENTION

The present invention is generally directed to paper wiping products. More particularly, the present invention is directed to single ply scrim-like paper wiping products made from a paper web containing bicomponent staple fibers into which has been embossed a grid-like reticular pattern. The wiping products of the present invention are strong, solvent resistant, tear resistant, abrasion resistant, and have great softness.

BACKGROUND OF THE INVENTION

A scrim refers to a course mesh made from heavy fibers that is used to bridge and reinforce opposing layers of an outer material. For instance, a scrim can be made from a network of inner locking threads forming a grid-like pattern. The threads can be made from synthetic or natural fibers. In the past, scrims have been commonly used to reinforce disposable washcloths and various other wiping products. The scrim was added to the wiping products in order to add strength to the sheets in both the machine direction and the cross direction.

For example, a disposable washcloth containing a scrim is disclosed in U.S. Pat. No. 3,597,299 to Thomas, et al. The disposable washcloth disclosed in Thomas, et al. includes a scrim made from a multiplicity of warp threads and filler threads. The threads of the scrim are coated with an adhesive, such as a plastisol, which is used to bond the threads together where they intercept. The adhesive is also used to adhere the scrim to a pair of opposing cellulose wadding layers. As described in Thomas, et al., once the scrim is adhered to the outer wadding layers, the laminate structure is microcreped.

In general, the wadding layers are included in the washcloth for their high liquid absorbency and liquid retention characteristics. The wadding layers should also be abrasion resistant. The scrim, on the other hand, is incorporated into the product in order to provide wet and dry strength.

In one embodiment, Thomas et al. also discloses adding to the formed scrim prior to lamination with the wadding layers a blend of cotton fibers and heat softenable fibers. The cotton fibers and heat softenable fibers are added in order to increase the surface roughness and the bulk of the washcloth.

The disposable washcloths disclosed in Thomas, et al. have proven to be well suited for use in residential and commercial applications. Unfortunately, however, the scrim containing wiper products disclosed in Thomas, et al. are relatively expensive to produce and manufacture. Specifically, a number of different and discrete operations must be performed in order to make the products. For instance, the scrim and the cellulose wadding layers must be formed separately prior to being combined into the resulting multi-layered product.

Besides being expensive to produce, the washcloths disclosed in Thomas, et al. have also experienced some delamination problems during use, particularly during heavy duty scrubbing operations in wet environments.

In view of the above, there is currently a need for a wiping product that can be used as a replacement to conventional scrim containing washcloths and towels. In particular, a need exists for a wiping product that can be made less expensively than a scrim containing product but which has comparable strength, absorbency and other physical characteristics. A need also exists for a scrim-like wiping product that can be made in one continuous operation. A need further exists for a scrim-like replacement product that will not delaminate.

SUMMARY OF THE INVENTION

The present invention recognizes and addresses the foregoing drawbacks, and deficiencies of prior art constructions and methods.

Accordingly, it is an object of the present invention to provide an improved scrim-like paper wiping product.

Another object of the present invention is to provide a scrim-like wiping product that is made from a single ply of material.

It is another object of the present invention to provide a single ply scrim-like wiping product that can be made continuously according to a single operation.

Still another object of the present invention is to provide a scrim-like wiping product that has good dry strength, good wet strength, is tear resistant, and is abrasion resistant.

It is another object of the present invention to provide a scrim-like wiping product that is softer than many conventional scrim products.

It is another object of the present invention to provide a scrim-like wiping product made from a single ply paper web that has been creped at least once on each side and then embossed.

These and other objects of the present invention are achieved by providing a method for producing a single ply scrim-like paper wiping product. The method includes the steps of providing a paper web containing softwood fibers in combination with bicomponent fibers. The bicomponent fibers include a core polymer surrounded by a sheath polymer. The core polymer has a melting temperature higher than the melting temperature of the sheath polymer.

A first bonding agent is applied to the first side of the web in a preselected pattern. The first side of the web is then adhered to a first creping surface and creped. Similarly, a second bonding agent is applied to the second side of the web in a preselected pattern. Once the bonding agent is applied, the second side of the web is adhered to a second creping surface and creped.

After being creped at least twice, a reticular pattern is embossed into the paper web. The reticular pattern comprises a network of compressed lines formed into the paper web under sufficient heat and pressure to cause the bicomponent fibers to fuse together within the lines.

In one embodiment, the bicomponent fibers and the softwood fibers are mixed homogeneously in forming the paper web. Alternatively, the paper web can include a first outer layer, a middle layer and a second outer layer, wherein the bicomponent fibers are contained within the middle layer. The bicomponent fibers can be present within the paper web in an amount from about 10% to about 30% by weight. In one example, the core polymer of the bicomponent fiber is made from polyester or nylon, while the sheath polymer is made from a polyolefin, such as polyethylene or polypropylene.

The bonding agents applied to the paper web can be applied in a pattern that covers from about 35% to about 55% of the surface area of each side of the web and particularly from about 40% to about 50% of the surface area. The first bonding agent and the second bonding agent can be applied to each side of the paper web in an amount from about 4% to about 8% by weight. Examples of bonding agents that may be used in the present invention include acrylates, vinyl acetates, vinyl chlorides, and methacrylates.

In one embodiment, the method of the present invention can further include the step of heating the paper web after it has been creped a second time. In particular, the paper web can be heated to a temperature sufficient to cure the first bonding agent, to cure the second bonding agent and to cause the bicomponent fibers to fuse together.

The reticular pattern that is embossed into the paper web can include, for instance, a grid. The compressed lines forming the grid can be spaced apart from about one fourth of an inch to about one half of inch. The reticular pattern can be embossed into the paper web by contacting the web with an embossing roll. The embossing roll can apply from about 2,000 psi to about 14,000 psi of pressure to the web. Preferably the paper web is heated to at least about 260° F. when embossed.

These and other objects of the present invention are also achieved by providing a single ply scrim-like paper wiping product. The paper wiping product includes a paper web containing softwood fibers in combination with bicomponent fibers. The bicomponent fibers include a core polymer surrounded by a sheath polymer. The core polymer can be, for instance, polyester or nylon while the sheath polymer can be polyethylene or polypropylene. The bicomponent fibers can be present within the paper web in an amount from about 10% to about 30% by weight.

A bonding agent is applied to each side of the web in a preselected pattern. The bonding agent covers from about 40% to about 50% of the surface area of each side of the web. The bonding agent is added to each side of the web in an amount from about 4% to about 8% by weight. In one preferred embodiment, the bonding agent comprises an ethylene vinyl acetate copolymer cross-linked with N-methyl acrylamide groups. Each side of the paper web is creped in the areas where the bonding agent has been applied.

The paper wiping product of the present invention further includes a reticular pattern embossed into at least one side of the web. The reticular pattern comprises a network of compressed lines formed into the web under sufficient heat and pressure to cause the bicomponent fibers to compress and fuse together within the lines.

The wiping product of the present invention can have a basis weight of from about 35 pounds per 2,880 square feet to about 55 pounds per 2,880 square feet.

Other objects, features, and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
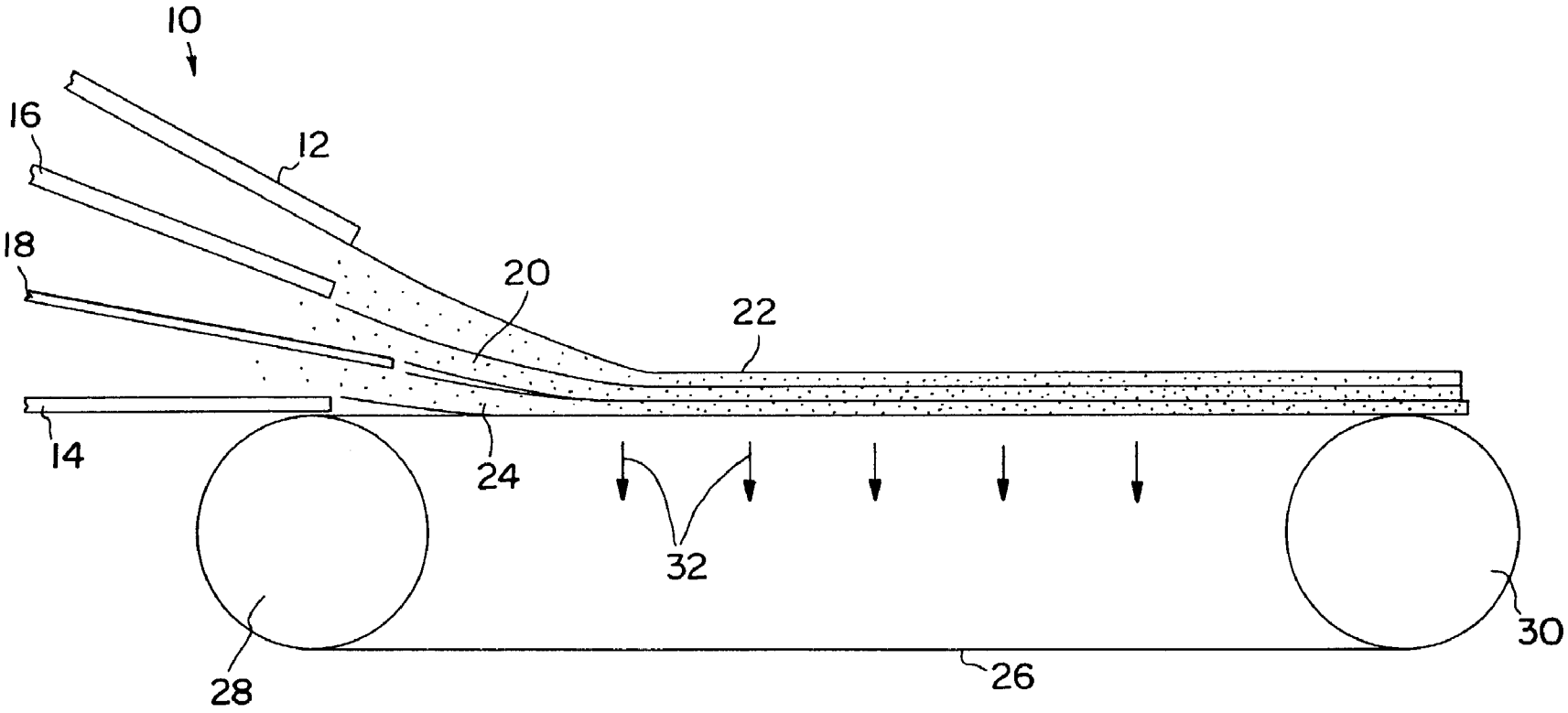
FIG. 1 is a schematic view of a paper web forming machine illustrating the formation of a paper web having multiple layers in accordance with the present invention.

Repeat use of reference characters in the present specification and drawings is intended to represent same or analogous features or elements of the present invention.

DETAILED DESCRIPTION OF PREFERRED EMBODIMENTS

It is to be understood by one of ordinary skill in the art that the present discussion is a description of exemplary embodiments only, and is not intended to limit the broader aspects of the present invention which broader aspects are embodied in the exemplary construction.

In general, the present invention is directed to a method for producing single ply scrim-like paper wiping products. Although the product of the present invention does not actually contain a scrim layer, the products are strong, tear resistant and abrasion resistant. In fact, in some embodiments, the wiping products of the present invention may have greater absorbency than many multi-layered scrim products made in the past.

Besides having great strength and abrasion resistance, the wiping products made according to the present invention also have good stretch characteristics, are tear resistant, and can be used to absorb solvents without disintegrating. The wiping products of the present invention are of the type that are generally used in heavy duty wiping operations and are particularly well suited for commercial use. The wiping products are made from a single ply and therefore do not delaminate. Of particular advantage, the wiping products of the present invention have improved softness characteristics over many similar products.

The process of the present invention generally involves first forming a paper web containing fusible bicomponent fibers. Once formed, a bonding agent is applied to both sides of the web and at least one side of the web is then creped. The bonding agent is applied in a preselected pattern for providing strength and stretchability without adversely affecting the softness of the sheet. Once creped on at least one side, in order to further increase the strength of the product, the paper web is passed through a pair of raised embossing rolls which imprint a scrim-like reticular pattern on the soft, bulky sheet. The embossing step takes place at a temperature and pressure sufficient to compress and fuse the bicomponent fibers together according to the pattern applied to the sheet.

The single ply paper web used to make the wiping products of the present invention generally contains softwood fibers in combination with bicomponent fibers. The bicomponent fibers are added to the paper web so that a reticular pattern can be embossed into the web as will be described hereinafter. The bicomponent fibers also improve the softness of the web.

In forming the paper web of the present invention, the softwood fibers and the bicomponent fibers can be mixed homogeneously or, in one preferred embodiment, can be combined in layers to form a stratified web. In general, the bicomponent fibers can be added to the web in an amount from about 10% to about 30% by weight. Specifically, the bicomponent fibers should be added in an amount to create a denseness within the web that will permit the bicomponent fibers to effectively fuse together when a pattern is embossed into the web. On the other hand, adding the bicomponent fibers in excessive amounts, such as greater than 30% by weight, can make the final product too stiff and can adversely affect absorbency characteristics.

Mixing the bicomponent fibers and the softwood fibers homogeneously in forming the web as opposed to combining the fibers in different layers generally provides a stronger and more composite structure. When the fibers are mixed homogeneously, however, greater amounts of bicomponent fibers must be added to the web in order to have a sufficient concentration of bicomponent fibers present when the web is embossed. For instance, when the fibers are mixed homogeneously, the bicomponent fibers should be present in an amount from about 20% to about 30% by weight, and particularly in an amount of about 25% by weight.

When forming a stratified fiber furnish, preferably the bicomponent fibers should be contained within a middle layer of the web. In this embodiment, since the bicomponent fibers are concentrated within a particular area of the web, less fibers are required in order to provide a heat fusible product. Thus, in this embodiment, the bicomponent fibers can be present in an amount from about 10% to about 20% by weight, and particularly in an amount of about 15% by weight.

For example, in one embodiment, the bicomponent fibers can be contained in the middle layer of a stratified fiber furnish in an amount of about 50% by weight, based on the weight of the middle layer. The middle layer can account for about 33% to about 40% of the total weight of the paper web. Because a lesser amount of bicomponent fibers are required in stratified paper webs according to the present invention, this embodiment tends to be less expensive to produce.

The softwood fibers used in the paper product of the present invention can vary and is generally not critical. For instance, in one embodiment, Northern softwood kraft fibers can be used. Northern softwood kraft fibers have a fiber length of about 1.8 mm to about 3 mm.

The bicomponent fibers used in the process of the present invention contain a core polymer surrounded by a sheath polymer. The sheath polymer should have a lower melting temperature than the core polymer. More particularly, according to the present invention, a bicomponent fiber should be chosen wherein the sheath polymer will not melt during some process steps, such as during creping operations, but will melt during other process steps, such as when the paper web is embossed.

For instance, at least one side of the paper web of the present invention as will be described hereinafter will be creped during formation of the wiping product. When creped, the paper web is typically placed on a heated roll, such as a Yankee dryer, and then creped from the surface of the dryer. If the bicomponent fibers were to melt during this step, the paper web would become compressed and loose bulk and softness. Since these types of dryers typically operate at temperatures of approximately 200° F., a sheath polymer should be chosen that has a melting temperature of at least above 200° F., and particularly above at least 220° F.

The sheath polymer, on the other hand, should melt causing the bicomponent fibers to fuse together when the paper web is embossed. In this regard, the sheath polymer should have a melting temperature generally below 330° F., and particularly below 290° F. Suitable polymers that may be used in the process of the present invention that have melting temperatures between from about 200° F. to about 300° F. include the polyolefin polymers, such as polyethylene and polypropylene.

The core polymer contained in the bicomponent fiber preferably does not melt or fuse during the entire process of the present invention. The core polymer should thus have a high melt temperature. Such polymers include, for instance, nylon and various polyesters.

Commercially available bicomponent fibers having the above characteristics include CELBOND fibers marketed by the Hoechst Cellanese Company. CELBOND bicomponent fibers contain a polyester core polymer surrounded by either polyethylene or polypropylene.

The length of the bicomponent fibers used in the process of the present invention should be from about one fourth of an inch to about one half of an inch and particularly from about one fourth of an inch to three eighths of an inch. Fiber lengths greater than one half inch tend to tangle in the headbox interfering with the formation of the paper web.

As described above, in one embodiment of the present invention, the bicomponent fibers are contained in a middle layer of the web. Referring to FIG. 1, one embodiment of a device for forming a multi-layered stratified pulp furnish is illustrated. As shown, a three-layered headbox generally 10 includes an upper headbox wall 12 and a lower headbox wall 14. Headbox 10 further includes a first divider 16 and a second divider 18 which separate three fibrous stock layers.

Each of the fiber layers comprise a dilute aqueous suspension of paper making fibers. In accordance with the present invention, middle layer 20 contains bicomponent fibers in combination with softwood fibers, such as Northern softwood kraft. Outer layers 22 and 24, on the other hand, contain primarily softwood fibers.

An endless traveling forming fabric 26, suitably supported and driven by rolls 28 and 30, receive the layered paper making stock issued from headbox 10. Once retained on fabric 26, the layered fibrous suspension passes water through the fabric as shown by the arrows 32. Water removal is achieved by combinations of gravity, centrifugal force and vacuum suction depending on the forming configuration.

Forming multi-layered paper webs is also described and disclosed in U.S. Pat. No. 5,129,988 to Farrington, Jr. and in U.S. Pat. No. 5,494,554 to Edwards, et al. which are both incorporated herein by reference.

Figure 2:
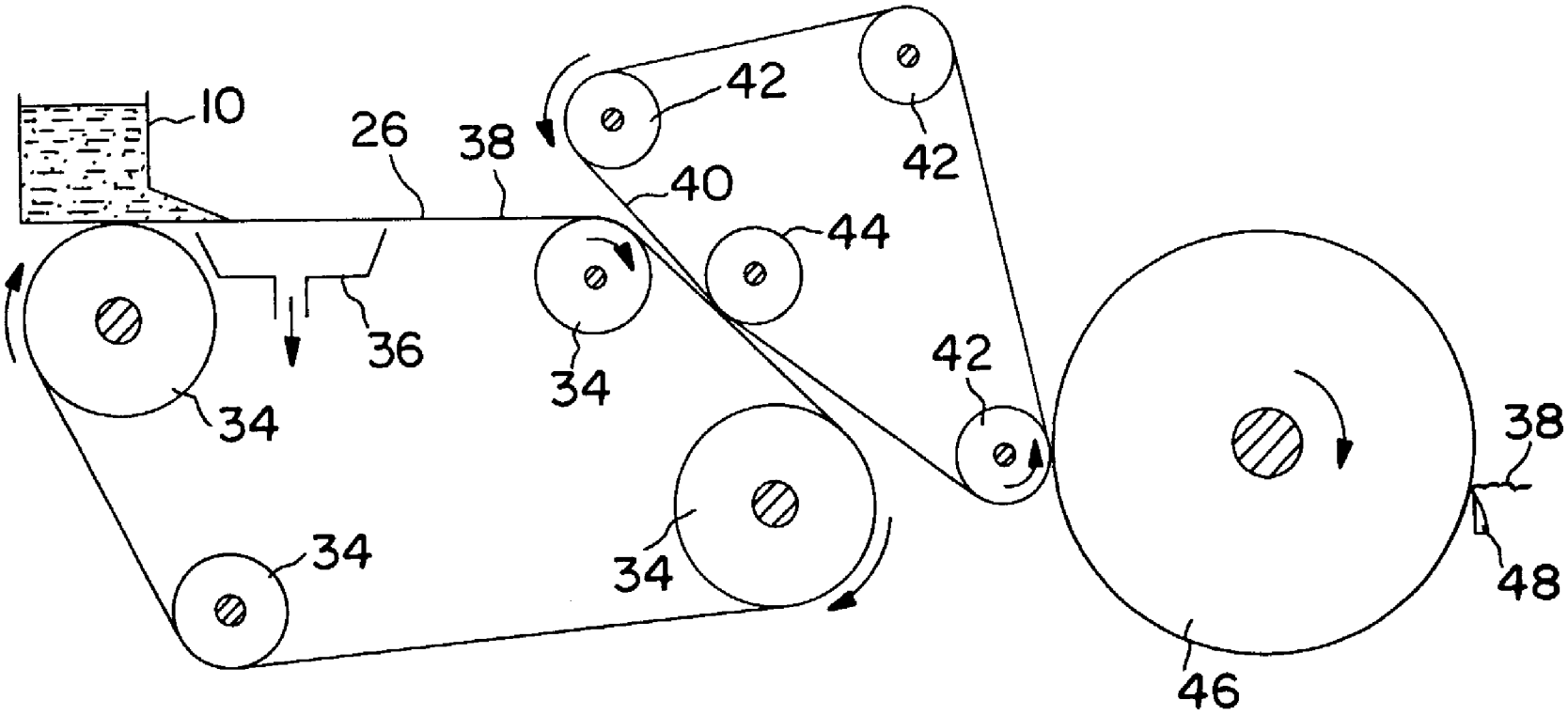
FIG. 2 is a schematic diagram of a paper web forming machine that crepes one side of the web.

Referring to FIG. 2, one embodiment of a paper making machine is illustrated capable of receiving the layered fiber suspension from headbox 10 and forming a paper web for use in the process of the present invention. The paper making machine illustrated in FIG. 2 can also be used to process homogeneous mixtures of fiber suspensions in accordance with the present invention if desired. As shown, in this embodiment, forming fabric 26 is supported and driven by a plurality of guide rolls 34. A vacuum box 36 is disposed beneath forming fabric 26 and is adapted to remove water from the fiber furnish to assist in forming a web.

From forming fabric 26, a formed web 38 is transferred to a second fabric 40, which may be either a wire or a felt. Fabric 40 is supported for movement around a continuous path by a plurality of guide rolls 42. Also included is a pick up roll 44 designed to facilitate transfer of web 38 from fabric 26 to fabric 40. Preferably, the speed at which fabric 40 is driven is approximately the same speed at which fabric 26 is driven so that movement of web 38 through the system is consistent.

From fabric 40, web 38, in this embodiment, is transferred to the surface of a rotatable heated dryer drum 46, such as a Yankee dryer. Web 38 is lightly pressed into engagement with the surface of dryer drum 46 to which it adheres, due to its moisture content and its preference for the smoother of the two surfaces. In some cases, however, a creping adhesive, such as an ethylene vinyl acetate, can be applied over the web surface or drum surface for facilitating attachment of the web to the drum.

As web 38 is carried through a portion of the rotational path of the dryer surface, heat is imparted to the web causing most of the moisture contained within the web to be evaporated. As described above, the web, however, should not be heated to a temperature sufficient to cause the sheath polymer of the bicomponent fibers to melt or soften. Web 36 is removed from dryer drum 46 by a creping blade 48. Although optional, creping web 38 as it is formed reduces internal bonding within the web and increases softness and bulk.

In an alternative preferred embodiment, web 38 can be through dried prior to being creped. A through dryer accomplishes the removal of moisture from the web by passing air through the web without applying any mechanical pressure. Through drying can further increase the bulk and softness of the web.

The paper web formed from the process illustrated in FIG. 2, possesses certain physical characteristics that are particularly advantageous for use in the remainder of the process of the present invention. In particular, paper web 38 is characterized by having an increased amount of softness, bulk, absorbency, and wicking ability. As will be described hereinafter, the remainder of the process of the present invention is designed not only to retain the above properties but also to provide the paper web with strength and stretchability.

Figure 3:
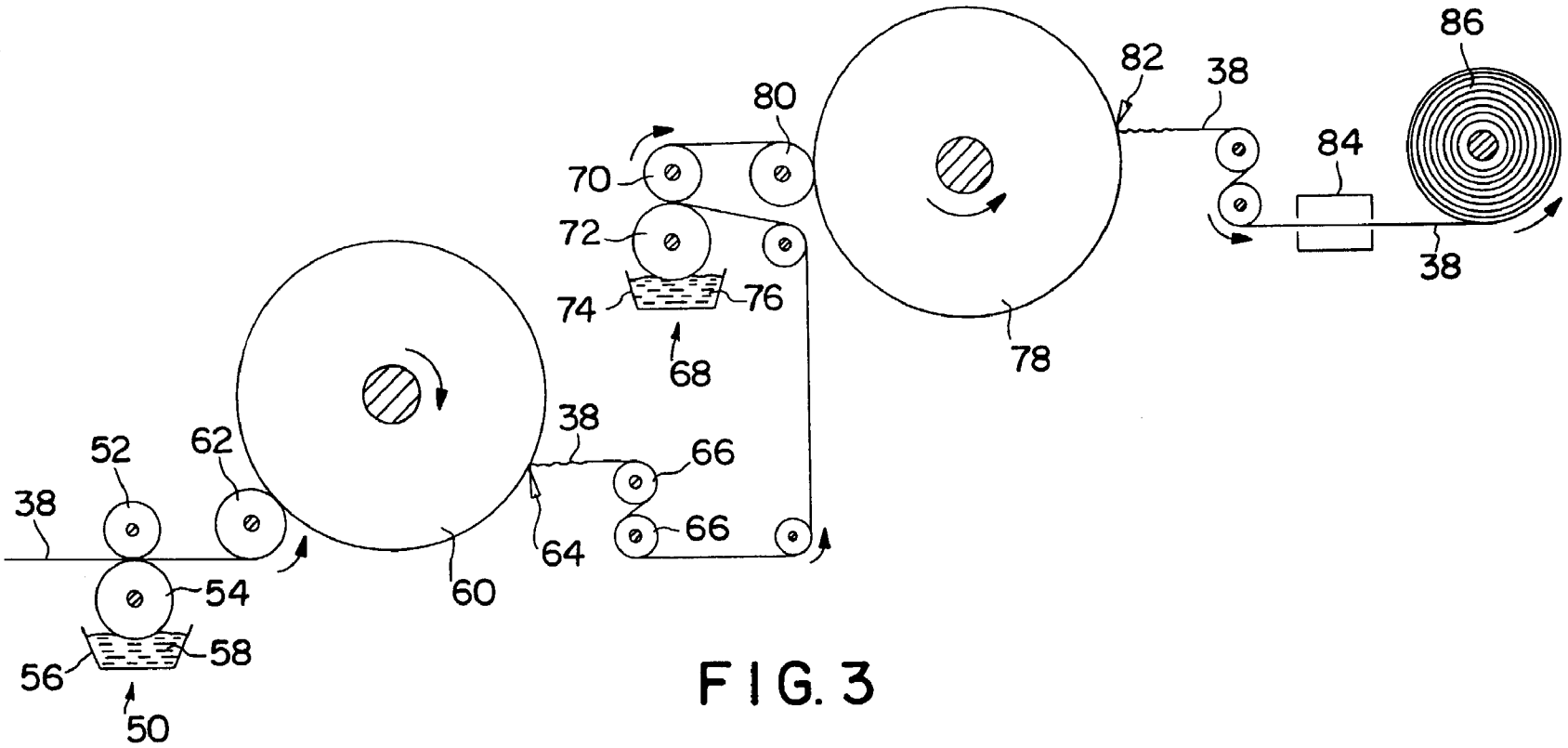
FIG. 3 is a schematic diagram of a portion of one embodiment of a system for producing scrim-like paper wiping products in accordance with the present invention.

Once paper web 38 is formed, a bonding agent is applied to each side of the web and at least one side of the web is then creped. For instance, a double recreping process that may be used in the process of the present invention is disclosed in U.S. Pat. No. 3,879,257 to Gentile, et al. which is incorporated herein by reference in its entirety. Referring to FIG. 3, one embodiment of an apparatus that may be used to crepe each side of a paper web is illustrated. As shown, paper web 38 made according to the process illustrated in FIG. 2 or according to a similar process, is passed through a first bonding agent application station generally 50. Station 50 includes a nip formed by a smooth rubber press roll 52 and a patterned rotogravure roll 54. Rotogravure roll 54 is in communication with a reservoir 56 containing a first bonding agent 58. Rotogravure roll 54 applies bonding agent 58 to one side of web 38 in a preselected pattern.

Web 38 is then pressed into contact with a first creping drum 60 by a press roll 62. The bonding agent causes only those portions of the web where it has been disposed to adhere to the creping surface. If desired, creping drum 60 can be heated for promoting attachment between the web and the surface of the drum and for partially drying the web. Creping drum 60, however, should not be heated to a temperature that will melt or soften the sheath polymer of the bicomponent fibers contained within paper web 38. In particular, while web 38 is on creping drum 60, the web is in a partially compressed state. If, during this step, the web were heated to temperatures sufficient to fuse the bicomponent fibers together, the web may loose a portion of its bulk.

Once adhered to creping drum 60, web 38 is brought into contact with a creping blade 64. Specifically, web 38 is removed from creping roll 60 by the action of creping blade 64, performing a first controlled pattern crepe on the web.

Once creped, web 38 can be advanced by pull rolls 66 to a second bonding agent application station generally 68. Station 68 includes a transfer roll 70 in contact with a rotogravure roll 72, which is in communication with a reservoir 74 containing a second bonding agent 76. Similar to station 50, second bonding agent 76 is applied to the opposite side of web 38 in a preselected pattern. Once the second bonding agent is applied, web 38 is adhered to a second creping roll 78 by a press roll 80. Web 38 is carried on the surface of creping drum 78 for a distance and then removed therefrom by the action of a second creping blade 82. Second creping blade 82 performs a second controlled pattern creping operation on the second side of the paper web.

Once creped for a second time, paper web 38, in this embodiment, is pulled through a curing or drying station 84. Drying station 84 can include any form of a heating unit, such as an oven energized by infrared heat, microwave energy, hot air or the like. Drying station 84 may be necessary in some applications to dry the web and/or cure the first and second bonding agents. Depending upon the bonding agents selected, however, in other applications drying station 84 may not be needed.

When included within the process of the present invention, drying station 84, in one embodiment, can heat paper web 38 to a temperature sufficient to soften the sheath polymer but to a temperature insufficient to soften or melt the core polymer of the bicomponent fibers. For instance, in one embodiment, drying station 84 can heat the paper web to a temperature of at least about 260° F., and particularly from about 260° to about 300° F. Within this temperature range, the sheath polymer of the bicomponent fibers will soften and cause adjacent fibers to bond together, locking in the bulk present within the web. During the drying operation, paper web 38 is not being compressed as occurs during the creping operation, but instead is in a puffed up state due to being creped twice. Thus, it is advantageous to lock in the bulk at this stage in the process. Once the bulk is set into place, the paper web can be further processed and compressed without loosing the bulk that is created during the creping operations.

In an alternative embodiment, drying station 84 is maintained at a lower temperature than that sufficient to soften the sheath polymer, such as at a temperature of less than 260° F. Within this temperature range, the bicomponent fibers do not soften and bond together. By preventing interfiber bonding, however, more bonding and fusion occur during the embossing step as will be described below.

Figure 4:
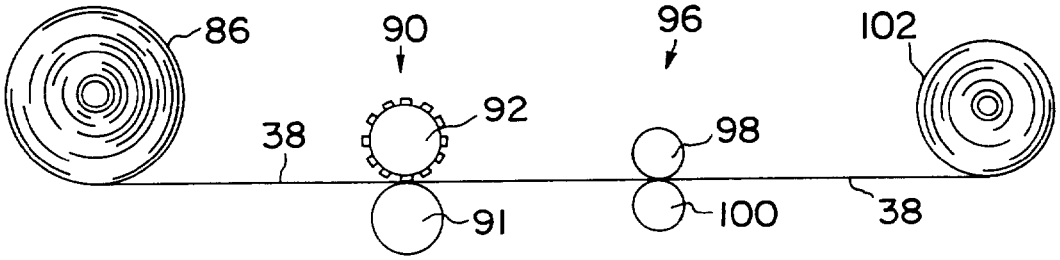
FIG. 4 is a schematic diagram of a portion of one embodiment of a system for forming scrim-like paper wiping products in accordance with the present invention.

Once drawn through drying station 84, web 38 can be wound into a roll of material 86 for further processing according to the present invention, as shown in FIG. 4. Alternatively, however, web 38 may be fed directly into further processing stations.

The bonding agents applied to each side of paper web 38 are selected for not only assisting in creping the web but also for adding dry strength, wet strength, stretchability, and tear resistance to the paper. The bonding agents also prevent lint from escaping from the wiping products during use.

The bonding agent is applied to the base web as described above in a preselected pattern. In one embodiment, for instance, the bonding agent can be applied to the web in a reticular pattern, such that the pattern is interconnected forming a net-like design on the surface.

In an alternative embodiment, however, the bonding agent is applied to the web in a pattern that represents a succession of discrete dots. Applying the bonding agent in discrete shapes, such as dots, provides sufficient strength to the web without covering a substantial portion of the surface area of the web. In particular, applying the bonding agents to the surfaces of the web adversely affects the absorbency of the web. Thus, it is preferable to minimize the amount of bonding agent applied.

Specifically, according to the present invention, the bonding agent is applied to each side of the paper web so as to cover from about 35% to about 55% of the surface area of the web. More particularly, in most applications, the bonding agent will cover from about 40% to about 50% of the surface area of each side of the web. The total amount of bonding agent applied to the web will preferably be in the range of from about 8% to about 16% by weight, based upon the total weight of the web. In other words, the bonding agent is applied to each side of the web at an add on rate of about 4% to about 8% by weight.

At the above amounts, the bonding agent can penetrate the paper web from about 20% to about 40% of the total thickness of the web. In most applications, the bonding agent should not penetrate over 50% of the web but should at least penetrate from about 10% to about 15% of the thickness of the web.

Particular bonding agents that may be used in the present invention include latex compositions, such as acrylates, vinyl acetates, vinyl chlorides, and methacrylates. Some water soluble bonding agents may also be used including polyacrylamides, polyvinyl alcohols, and carboxymethyl cellulose.

In one preferred embodiment, the bonding agent used in the process of the present invention comprises an ethylene vinyl acetate copolymer. In particular, the ethylene vinyl acetate copolymer is preferably cross-linked with N-methyl acrylamide groups using an acid catalyst. Suitable acid catalysts include ammonium chloride, citric acid, and maleic acid. The bonding agent should have a glass transition temperature of not lower than −10° F. and not higher than +10° F.

Once paper web 38 is passed through drying station 84, a reticular pattern is embossed into the paper web to produce a scrim-like product in accordance with the present invention. The pattern can be embossed into one side of the web or into both sides. For instance, referring to FIG. 4, one embodiment of an embossing operation is illustrated.

As shown, the roll of material 86 formed according to the process illustrated in FIG. 3 is fed through an embossing station generally 90. Embossing station 90 includes a raised embossing roll 92 in communication with a press roll 94. In one embodiment, embossing roll 92 is a steel roll containing a raised pattern, while press roll 94 is a smooth steel roll. In an alternative embodiment, however, both rolls 92 and 94 can have a complimentary aligned raised pattern. In a further embodiment, only one roll contains a raised pattern but the paper web is embossed on both sides.

As paper web 38 is fed through embossing station 90, a reticular pattern is embossed into the web at a temperature and pressure sufficient to soften the sheath polymer and fuse together the bicomponent fibers contained within the embossing pattern.

The pattern embossed into the web can be, for instance, a grid-like pattern containing two sets of intersecting parallel lines. For instance, in one preferred embodiment, a diamond pattern is embossed into the web. When embossing a grid-like pattern into the web, the compressed fuse lines should be spaced from about one fourth of an inch to about one half of an inch apart, and particularly from about one fourth of an inch to three eighths of an inch apart. Spacing the lines closer together will create a very tight pattern that may reduce the bulk and softness of the web. Spacing the lines greater than one half of an inch apart, however, may not adequately enhance the strength characteristics of the web as may be desired in heavy duty wiping operations.

The sheet temperature at which the web is embossed should be slightly above the softening temperature of the sheath polymer but below the melting point of the core polymer of the bicomponent fibers. In one embodiment, web 38 is heated using a heated embossing roll and a heated press roll. Alternatively, however, web 38 can be fed directly into embossing station 90 from drying station 84. Paper web 38 within drying station 84 can be heated to a temperature sufficient for the embossing operation. Thus, in a continuous operation, it may not be necessary to heat embossing roll 92 and press roll 94. Besides being heated, pressure is also applied to paper web 38 according to the reticular pattern during the embossing operation. In this regard, embossing roll 92 and press roll 94 apply pressure to the web in an amount sufficient to create the compressed and fused sections within the web.

In general, when the reticular pattern is embossed into paper web 38, the paper web should be heated to a temperature of from about 260° F. to about 300° F., and particularly to about 290° F. Embossing roll 92 and press roll 94 can apply from about 2,000 psi to about 14,000 psi, and particularly from about 2,000 psi to about 12,000 psi of pressure to the web according to the pattern.

From embossing station 90, paper web 38 can then be fed to a cooling station generally 96. Cooling station 96 includes a first cooling roll 98 in communication with a second cooling roll 100 that are adapted to receive the paper web therethrough. Cooling station 96 is used to cool the paper web in order to lock in the embossed design and structure of the web prior to being wound into a roll of material 102. For instance, cooling rolls 98 and 100 can be refrigerated rolls at a temperature of from about 35° F. to about 50° F.

Once wound into rolling material 102, the wiping product of the present invention can then be transferred to another location and cut into commercial size sheets for packaging as a scrim-like wiping product.

Figure 5:
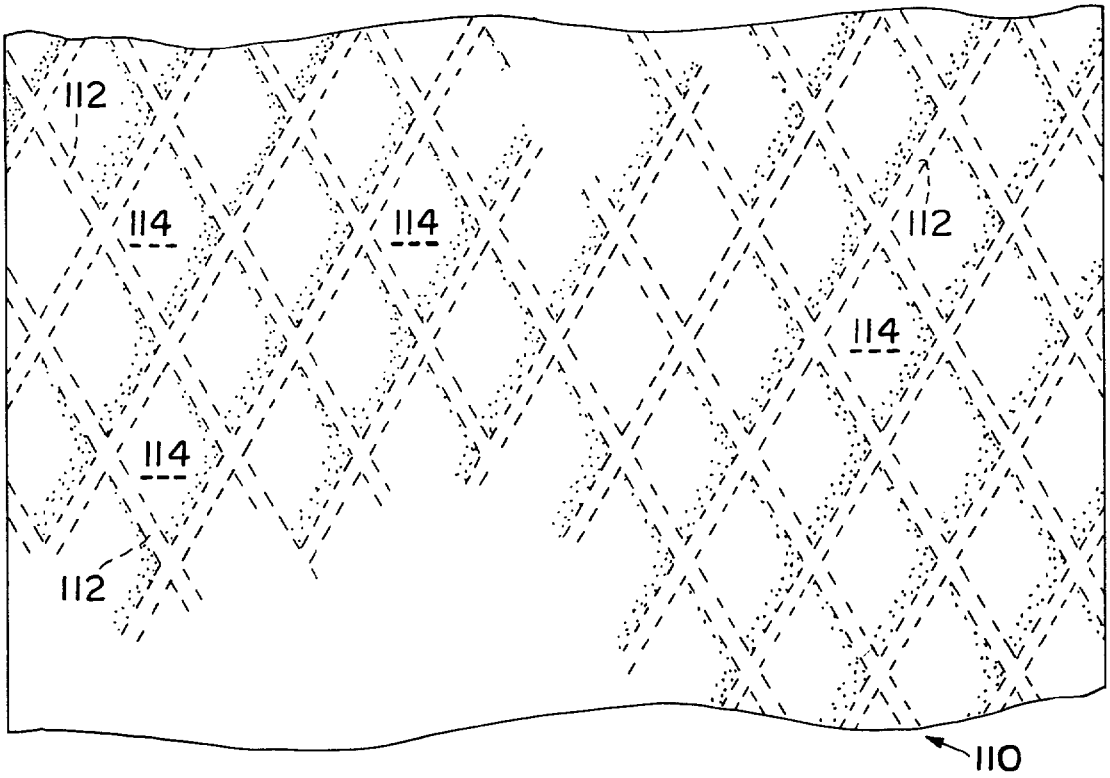
FIG. 5 is a plan view of one embodiment of a scrim-like paper wiping product made in accordance with the present invention.

Referring to FIG. 5, one embodiment of a wiping product generally 110 made in accordance with the present invention is illustrated. As shown, wiping product 110 includes an interconnected network of compressed fused lines 112 which form a grid-like pattern into the paper web. Compressed lines 112 provide strength to wiping product 110 in especially the cross direction and the machine direction.

Contained between compressed lines 112 are formed a plurality of pillow-like grids 114. Pillow-like grids 114 are made from a netting with great bulk, softness, and absorbency.

Single ply scrim-like wiping products made according to the above described process provide many advantages and benefits over various conventional wiping products and provide a less expensive alternative to scrim containing products. The wiping products made according to the present invention have good strength when either wet or dry, have improved solvent resistance, have good tear resistance, have good abrasion resistance, and have good softness. The basis weight of the scrim-like wiping products can be from about 35 pounds per 2,880 square feet (ream) to about 55 pounds per ream. The ratio of bulk to basis weight for the wiping product is between about 10 to about 16 bulk per basis weight units.

The present invention may be better understood with reference to the following examples.

EXAMPLE

The following tests were run to demonstrate the strength characteristics of wiping products made in accordance with the present invention.

Five (5) different samples of paper were made and tested. Each of the samples were made from a stratified paper web having a basis weight of 50 pounds per ream. Each of the samples were printed on both sides with an ethylene vinyl acetate latex adhesive and both sides were creped in a process similar to the one illustrated in FIG. 3. A WYPALL gravure roll was used to apply the latex adhesive in a diamond pattern. Each of the samples were made as follows:

Sample No. 1

Paper sample number 1 was a double creped paper made as described above containing no bicomponent fibers.

Sample No. 2

Paper sample number 2 was made similar to paper sample number 1. Paper sample number 2, however, included a middle layer containing 35% by weight of ¼ inch CELBOND bicomponent fibers obtained from the Hoechst Cellanese Company. The remainder of the middle layer of the paper web comprised Northern softwood kraft fibers. The middle layer accounted for 40% of the total weight of the web.

Sample No. 3

Paper sample number 3 was made by embossing a reticulated grid-like pattern into one side of paper sample number 2. A knuckle wire was used during the embossing process. During the embossing step, the paper was heated to 300° F. and was allowed to contact the embossing roll for 5 seconds at 10,000 psi.

Sample No. 4

Paper sample number 4 was made by embossing a reticulated grid-like pattern into one side of paper sample number 2. A knuckle wire was used during the embossing process. During the embossing step, the paper was heated to 300° F. and was allowed to contact the embossing roll for 10 seconds at 10,000 psi.

Sample No. 5

Paper sample number 5 was made by embossing a reticulated grid-like pattern into paper sample number 2. A knuckle wire was used during the embossing process. During the embossing step, the paper was heated to 300° F. and was allowed to contact the embossing roll for 10 seconds at 10,000 psi. In this example, both sides of the web were embossed.

Once formed, each of the above paper samples were wetted with water. A tensile strength test was then performed three times on each sample in the cross-direction.

The following results were obtained:

| Sample No. | Avg. Cross-Direction wet Tensile Strength (oz/in) |
|---|---|
| 1 | 26 |
| 2 | 40 |
| 3 | 52 |
| 4 | 52 |
| 5 | 57 |

As shown above, adding bicomponent fibers to a paper web greatly increases its strength. Also, the above results show that embossing a grid-like pattern into a paper web containing bicomponent fibers also serves to increase the strength of the web. Further, it appears that embossing both side of the web increases the strength of the web more than just embossing a single side.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A single ply paper wiping product comprising:

a paper web containing pulp fibers in combination with bicomponent fibers, said bicomponent fibers including a core polymer surrounded by a sheath polymer, said core polymer comprising a material selected from the group consisting of polyester and nylon, said sheath polymer comprising a material selected from the group consisting of polyethylene and polypropylene, said bicomponent fibers being present within said paper web in an amount from about 10% to about 30% by weight, said paper web having a first side and a second side;

a bonding agent applied to said first side of said web and to said second side of said web in a preselected pattern, said first side and said second side of said paper web being creped in the areas where said bonding agent has been applied; and a reticular pattern embossed into at least one side of said paper web, said reticular pattern comprising a network of compressed lines formed into said paper web under sufficient heat and pressure to cause said bicomponent fibers to compress and fuse together within said lines.

2. A paper wiping product as defined in claim 1, wherein said bonding agent comprises an ethylene vinyl acetate copolymer cross-linked with N-methyl acrylamide groups.

3. A paper wiping product as defined in claim 1, wherein said paper web further includes a middle layer, a first outer layer, and a second outer layer, said bicomponent fibers being contained within said middle layer, said bicomponent fibers being added to said paper web in an amount from about 10% to about 20% by weight.

4. A paper wiping product as defined in claim 1, wherein said product has a basis weight of from about 35 pounds per 2,880 square feet to about 55 pounds per 2,880 square feet.

5. A paper wiping product as defined in claim 1, wherein said pulp fibers comprise softwood fibers.

6. A paper wiping product as defined in claim 1, wherein said bonding agent is applied so as to cover from about 40% to about 50% of the surface area of each side of the web.

7. A paper wiping product as defined in claim 1, wherein the bonding agent is applied to each side of the web in an amount from about 4% to about 8% by weight.

8. A paper wiping product as defined in claim 1, wherein the bonding agent comprises a material selected from the group consisting of an acrylate, a vinyl acetate, a vinyl chloride and a methacrylate.

9. A method for producing a single ply paper wiping product comprising the steps of:

providing a paper web containing pulp fibers in combination with bicomponent fibers, said bicomponent fibers comprising a core polymer surrounded by a sheath polymer, said core polymer having a melting temperature higher than the melting temperature of said sheath polymer, said paper web having a first side and a second side;

applying a first bonding agent to said first side of said web in a preselected pattern;

applying a second bonding agent to said second side of said web in a preselected pattern;

creping at least one side of said web; and embossing a reticular pattern into said paper web, said reticular pattern comprising a network of compressed lines formed into said paper web under sufficient heat and pressure to cause said bicomponent fibers to fuse together within said lines.

10. A method as defined in claim 9, wherein both sides of said web are creped.

11. A method as defined in claim 9, wherein said paper web includes a first outer layer, a middle layer and a second outer layer, said bicomponent fibers being contained within said middle layer.

12. A method as defined in claim 9, wherein said bicomponent fibers are present within said paper web in an amount from about 10% to about 30% by weight.

13. A method as defined in claim 9, wherein said core polymer comprises a material selected from the group consisting of polyester and nylon, and wherein said sheath polymer comprises a polyolefin.

14. A method as defined in claim 9, wherein said first bonding agent is applied to said first side of said paper web in a pattern that covers from about 40% to about 50% of the surface area of said first side, and wherein said second bonding agent is applied to said second side of said paper web in a pattern that covers from about 40% to about 50% of the surface area of said second side and wherein said first bonding agent is applied to said first side of said paper web in an amount from about 4% to about 8% by weight and wherein said second bonding agent is applied to said second side of said paper web in an amount also from about 4% to about 8% by weight.

15. A method as defined in claim 9, wherein said first bonding agent and said second bonding agent comprise a material selected from the group consisting of an acrylate, a vinyl acetate, a vinyl chloride, or a methacrylate.

16. A method as defined in claim 9, further comprising the step of heating said paper web after being creped, said paper web being heated to a temperature sufficient to cure said first bonding agent, to cure said second bonding agent, and to cause said bicomponent fibers to fuse together.

17. A method as defined in claim 9, wherein said reticular pattern embossed into said paper web comprises a grid, said compressed lines forming said grid being spaced from about one fourth of an inch to about one half of an inch apart.

18. A method as defined in claim 9, wherein prior to applying said first bonding agent, said paper web is through dried during formation of the web and is then creped.

19. A single ply paper wiping product made according to the method defined in claim 9, wherein said wiping product has a basis weight of from about 35 to about 55 pounds per 2,880 square feet of web.

20. A method as defined in claim 9, wherein said pulp fibers comprise softwood fibers.

21. A method for producing a single ply paper wiping product comprising the steps of:

providing a paper web containing softwood fibers in combination with bicomponent fibers, said bicomponent fibers comprising a core polymer surrounded by a sheath polymer, said core polymer having a melting temperature higher than the melting temperature of said sheath polymer, said bicomponent fibers being present within said paper web in an amount from about 10% to about 30% by weight, said paper web having a first side and a second side;

applying a bonding agent to said first side of said web in a preselected pattern, said bonding agent being added to said first side in an amount from about 4% to about 8% by weight of said web, said bonding agent being used to adhere said first side of said web to a first creping surface;

creping said first side of said web from said first creping surface;

applying said bonding agent to said second side of said web in a preselected pattern, said bonding agent being added to said second side in an amount from about 4% to about 8% by weight based on the weight of said web, said bonding agent being used to adhere said second side of said web to a second creping surface;

creping said second side of said web from said second creping surface; and embossing a reticular pattern into said paper web, said reticular pattern comprising a network of compressed lines formed into said paper web under sufficient heat and pressure to cause said bicomponent fibers to fuse together within said lines.

22. A method as defined in claim 21, wherein said paper web includes a middle layer, a first outer layer, and a second outer layer, said bicomponent fibers being contained within said middle layer and being present within said web in an amount from about 10% to about 20% by weight.

23. A method as defined in claim 21, wherein said softwood fibers and said bicomponent fibers are mixed homogeneously throughout said web, said bicomponent fibers being present within said web in an amount from about 20% to about 30% by weight.

24. A method as defined in claim 21, wherein said bonding agent is applied to each side of said paper web in a pattern that covers from about 35% to about 55% of the surface area of each side, and wherein said bonding agent penetrates into said web from each side in an amount from about 20% to about 40% of the total thickness of said web.

25. A method as defined in claim 24, wherein said bonding agent comprises an ethylene vinyl acetate copolymer cross-linked with N-methyl acrylamide groups.

26. A method as defined in claim 21, wherein said paper wiping product has a basis weight of from about 35 pounds per 2,880 square feet to about 55 pounds per 2,880 square feet.

27. A method as defined in claim 21, wherein said reticular pattern is embossed into said paper web by contacting said paper web with an embossing roll, said embossing roll applying from about 2,000 psi to about 14,000 psi of pressure to said web.

28. A method as defined in claim 27, wherein said embossing roll is heated to at least about 260° F. when contacting said paper web.

29. A method for producing a single ply paper wiping product comprising the steps of:

providing a paper web containing softwood fibers in combination with bicomponent fibers, said bicomponent fibers including a core polymer surrounded by a sheath polymer, said core polymer comprising a material selected from the group consisting of polyester and nylon, said sheath polymer comprising a material selected from the group consisting of polyethylene and polypropylene, said bicomponent fibers being present within said paper web in an amount from about 10% to about 30% by weight, said paper web having a first side and a second side;

applying a bonding agent to said first side of said web in a preselected pattern, said bonding agent covering from about 40% to about 50% of the surface area of said first side of said web, said bonding agent being added in an amount from about 4% to about 8% by weight, said bonding agent being used to adhere said first side of said paper web to a first creping surface;

creping said first side of said web from said first creping surface;

applying said bonding agent to said second side of said web in a preselected pattern, said bonding agent covering from about 40% to about 50% of the surface area of said second side of said web, said bonding agent being added in an amount from about 4% to about 8% by weight, said bonding agent being used to adhere said second side of said web to a second creping surface;

creping said second side of said web from said second creping surface;

heating said paper web to a temperature sufficient to cure said bonding agent, said temperature being above the softening point of said sheath polymer causing said bicomponent fibers to fuse together; and while said paper web is at a temperature above the softening point of said sheath polymer, embossing a reticular pattern into said paper web, said reticular pattern comprising a network of compressed lines formed into said paper web under sufficient pressure to cause said bicomponent fibers to compress and fuse together within said lines.

30. A method as defined in claim 29, wherein said paper wiping product has a basis weight of from about 35 pounds per 2,880 square feet to about 55 pounds per 2,880 square feet.

31. A method as defined in claim 30, wherein said paper web includes a middle layer, a first outer layer and a second outer layer, said middle layer containing said bicomponent fibers.

32. A method as defined in claim 30, wherein said reticular pattern embossed into said paper web comprises a grid, said compressed lines formed into said paper web being spaced apart from about one fourth of an inch to about one half of an inch.

33. A method as defined in claim 29, wherein said reticular pattern is embossed into both sides of said paper web.

* * * * *